US005418419A

United States Patent [19]

McGuire

[11] Patent Number: 5,418,419

[45] Date of Patent: May 23, 1995

[54] LAMP FOR PRODUCING A DAYLIGHT SPECTRUM

[75] Inventor: Kevin P. McGuire, Rochester, N.Y.

[73] Assignee: Tailored Lighting Inc., Pittsford, N.Y.

[21] Appl. No.: 216,495

[22] Filed: Mar. 22, 1994

[51] Int. Cl.[6] ..... H01J 5/16

[52] U.S. Cl. ..... 313/113; 313/487; 356/230; 362/2; 362/293

[58] Field of Search ..... 313/113, 487; 356/230; 362/2, 293

[56] References Cited

U.S. PATENT DOCUMENTS

| | | | |
|---|---|---|---|
| 3,757,103 | 9/1973 | Walter | 362/2 |
| 3,875,453 | 4/1975 | Thornton, Jr. | 313/487 |
| 4,346,324 | 8/1982 | Yoldas | 313/113 |
| 4,458,176 | 7/1984 | Chenot et al. | 313/487 |
| 4,608,512 | 8/1986 | Rakitsch | 313/113 |
| 4,870,318 | 9/1989 | Csanyi et al. | 313/113 |
| 5,060,118 | 10/1991 | Penrod et al. | 356/230 |
| 5,177,396 | 1/1993 | Gielen et al. | 313/113 |
| 5,272,409 | 12/1993 | Van Dulmen et al. | 313/113 |

*Primary Examiner*—Sandra L. O'Shea
*Assistant Examiner*—Ali Horri
*Attorney, Agent, or Firm*—Howard J. Greenwald

[57] ABSTRACT

A lamp for producing a spectral distribution which is substantially identical to daylight color temperature. The lamp contains a filament which, when excited by electrical energy, emits radiant energy at least within the visible spectrum with wavelengths from about 400 to about 700 nanometers, a reflector body with a surface to intercept and reflect the visible spectrum radiant energy which is positioned within the reflector so that at least 50 percent of the visible spectrum radiant energy is directed towards the reflector surface, and a coating on the surface of the reflector body from which the reflected radiance of each wavelength of visible spectrum radiant energy directed towards the reflector surface when combined with the visible spectrum radiant energy not directed towards the reflector surface produces a total light output in substantial accordance with a specified formula.

21 Claims, 11 Drawing Sheets

| Wavelength | Black Body Source | Normal Daylight | Optimal Filter | Optimal Filter Norm. |
|---|---|---|---|---|
| 380 | 0.3072 | 0.6977 | 2.2712 | 70.7580 |
| 390 | 0.3690 | 0.8511 | 2.3068 | 71.8661 |
| 400 | 0.4377 | 1.4051 | 3.2099 | 100.0000 |
| 410 | 0.5135 | 1.6106 | 3.1367 | 97.7212 |
| 420 | 0.5960 | 1.7111 | 2.8710 | 89.4427 |
| 430 | 0.6851 | 1.6480 | 2.4055 | 74.9409 |
| 440 | 0.7805 | 2.1330 | 2.7329 | 85.1403 |
| 450 | 0.8818 | 2.4874 | 2.8207 | 87.8767 |
| 460 | 0.9886 | 2.5835 | 2.6132 | 81.4111 |
| 470 | 1.1005 | 2.6052 | 2.3674 | 73.7537 |
| 480 | 1.2168 | 2.7120 | 2.2289 | 69.4381 |
| 490 | 1.3370 | 2.6225 | 1.9614 | 61.1064 |
| 500 | 1.4607 | 2.7299 | 1.8690 | 58.2256 |
| 510 | 1.5871 | 2.7554 | 1.7361 | 54.0874 |
| 520 | 1.7158 | 2.7703 | 1.6146 | 50.3017 |
| 530 | 1.8460 | 2.9122 | 1.5775 | 49.1459 |
| 540 | 1.9774 | 2.8739 | 1.4534 | 45.2788 |
| 550 | 2.1093 | 2.9186 | 1.3837 | 43.1076 |
| 560 | 2.2411 | 2.8526 | 1.2728 | 39.6540 |
| 570 | 2.3724 | 2.7880 | 1.1752 | 36.6114 |
| 580 | 2.5028 | 2.8219 | 1.1275 | 35.1262 |
| 590 | 2.6316 | 2.6675 | 1.0136 | 31.5781 |
| 600 | 2.7586 | 2.7871 | 1.0103 | 31.4760 |
| 610 | 2.8834 | 2.8324 | 0.9823 | 30.6032 |
| 620 | 3.0055 | 2.8260 | 0.9403 | 29.2935 |
| 630 | 3.1247 | 2.7314 | 0.8741 | 27.2325 |
| 640 | 3.2407 | 2.8210 | 0.8705 | 27.1197 |
| 650 | 3.3532 | 2.7301 | 0.8142 | 25.3647 |
| 660 | 3.4620 | 2.8022 | 0.8094 | 25.2165 |
| 670 | 3.5670 | 2.9397 | 0.8241 | 25.6754 |
| 680 | 3.6679 | 2.8293 | 0.7714 | 24.0314 |
| 690 | 3.7647 | 2.4938 | 0.6624 | 20.6375 |
| 700 | 3.8572 | 2.6145 | 0.6778 | 21.1169 |
| 710 | 3.9453 | 2.6510 | 0.6719 | 20.9337 |
| 720 | 4.0290 | 2.1934 | 0.5444 | 16.9602 |
| 730 | 4.1083 | 2.4689 | 0.6010 | 18.7226 |
| 740 | 4.1831 | 2.6421 | 0.6316 | 19.6774 |
| 750 | 4.2534 | 2.2326 | 0.5249 | 16.3524 |
| 760 | 4.3193 | 1.6465 | 0.3812 | 11.8756 |
| 770 | 4.3808 | 2.3666 | 0.5402 | 16.8296 |
| 780 | 4.4380 | 2.2339 | 0.5034 | 15.6815 |
| | 100.0000 | 100.00 | | |

FIG. 6A

| Wavelength | Black Body Source | Normal Daylight | Optimal Filter | Optimal Filter Norm. |
|---|---|---|---|---|
| 380 | 0.3072 | 0.3954 | 1.2872 | 62.7260 |
| 390 | 0.3690 | 0.4805 | 1.3022 | 63.4566 |
| 400 | 0.4377 | 0.7837 | 1.7903 | 87.2394 |
| 410 | 0.5135 | 0.9822 | 1.9129 | 93.2162 |
| 420 | 0.5960 | 1.0955 | 1.8380 | 89.5664 |
| 430 | 0.6851 | 1.0853 | 1.5841 | 77.1908 |
| 440 | 0.7805 | 1.4764 | 1.8916 | 92.1760 |
| 450 | 0.8818 | 1.8096 | 2.0521 | 100.0000 |
| 460 | 0.9886 | 1.9464 | 1.9687 | 95.9362 |
| 470 | 1.1005 | 2.0336 | 1.8479 | 90.0492 |
| 480 | 1.2168 | 2.1784 | 1.7903 | 87.2400 |
| 490 | 1.3370 | 2.1871 | 1.6358 | 79.7123 |
| 500 | 1.4607 | 2.3533 | 1.6111 | 78.5079 |
| 510 | 1.5871 | 2.4243 | 1.5275 | 74.4338 |
| 520 | 1.7158 | 2.4980 | 1.4559 | 70.9452 |
| 530 | 1.8460 | 2.6752 | 1.4491 | 70.6166 |
| 540 | 1.9774 | 2.6893 | 1.3600 | 66.2726 |
| 550 | 2.1093 | 2.7706 | 1.3135 | 64.0077 |
| 560 | 2.2411 | 2.7464 | 1.2255 | 59.7168 |
| 570 | 2.3724 | 2.7144 | 1.1441 | 55.7541 |
| 580 | 2.5028 | 2.7864 | 1.1133 | 54.2523 |
| 590 | 2.6316 | 2.7297 | 1.0373 | 50.5460 |
| 600 | 2.7586 | 2.9350 | 1.0639 | 51.8453 |
| 610 | 2.8834 | 3.0466 | 1.0566 | 51.4889 |
| 620 | 3.0055 | 3.0913 | 1.0285 | 50.1209 |
| 630 | 3.1247 | 3.0337 | 0.9709 | 47.3103 |
| 640 | 3.2407 | 3.2283 | 0.9962 | 48.5436 |
| 650 | 3.3532 | 3.1729 | 0.9462 | 46.1096 |
| 660 | 3.4620 | 3.3322 | 0.9625 | 46.9029 |
| 670 | 3.5670 | 3.5569 | 0.9972 | 48.5923 |
| 680 | 3.6679 | 3.4690 | 0.9458 | 46.0869 |
| 690 | 3.7647 | 3.0181 | 0.8017 | 39.0661 |
| 700 | 3.8572 | 3.2241 | 0.8359 | 40.7323 |
| 710 | 3.9453 | 3.1914 | 0.8089 | 39.4181 |
| 720 | 4.0290 | 2.6378 | 0.6547 | 31.9030 |
| 730 | 4.1083 | 2.9492 | 0.7179 | 34.9817 |
| 740 | 4.1831 | 3.1459 | 0.7521 | 36.6477 |
| 750 | 4.2534 | 2.6536 | 0.6239 | 30.4010 |
| 760 | 4.3193 | 1.9751 | 0.4573 | 22.2825 |
| 770 | 4.3808 | 2.8345 | 0.6470 | 31.5291 |
| 780 | 4.4380 | 2.6629 | 0.6000 | 29.2392 |
| | 100.0000 | 100.00 | | |

FIG. 6B

| Wavelength | Black Body Source | Normal Daylight | Optimal Filter | Optimal Filter Norm. |
|---|---|---|---|---|
| 380 | 0.3072 | 1.3968 | 4.5471 | 86.0367 |
| 390 | 0.3690 | 1.5276 | 4.1401 | 78.3357 |
| 400 | 0.4377 | 2.3135 | 5.2851 | 100.0000 |
| 410 | 0.5135 | 2.5577 | 4.9812 | 94.2506 |
| 420 | 0.5960 | 2.6122 | 4.3830 | 82.9307 |
| 430 | 0.6851 | 2.4236 | 3.5376 | 66.9355 |
| 440 | 0.7805 | 2.9323 | 3.7569 | 71.0853 |
| 450 | 0.8818 | 3.2721 | 3.7105 | 70.2074 |
| 460 | 0.9886 | 3.2947 | 3.3325 | 63.0556 |
| 470 | 1.1005 | 3.2123 | 2.9191 | 55.2318 |
| 480 | 1.2168 | 3.2422 | 2.6645 | 50.4161 |
| 490 | 1.3370 | 3.0433 | 2.2762 | 43.0680 |
| 500 | 1.4607 | 3.0587 | 2.0940 | 39.6216 |
| 510 | 1.5871 | 3.0154 | 1.8999 | 35.9487 |
| 520 | 1.7158 | 2.9313 | 1.7085 | 32.3259 |
| 530 | 1.8460 | 3.0125 | 1.6319 | 30.8769 |
| 540 | 1.9774 | 2.9207 | 1.4771 | 27.9475 |
| 550 | 2.1093 | 2.9108 | 1.3800 | 26.1109 |
| 560 | 2.2411 | 2.7976 | 1.2483 | 23.6197 |
| 570 | 2.3724 | 2.6952 | 1.1360 | 21.4948 |
| 580 | 2.5028 | 2.6799 | 1.0708 | 20.2606 |
| 590 | 2.6316 | 2.4813 | 0.9429 | 17.8401 |
| 600 | 2.7586 | 2.5183 | 0.9129 | 17.2730 |
| 610 | 2.8834 | 2.5070 | 0.8695 | 16.4515 |
| 620 | 3.0055 | 2.4539 | 0.8165 | 15.4487 |
| 630 | 3.1247 | 2.3306 | 0.7459 | 14.1125 |
| 640 | 3.2407 | 2.3421 | 0.7227 | 13.6749 |
| 650 | 3.3532 | 2.2394 | 0.6678 | 12.6364 |
| 660 | 3.4620 | 2.2447 | 0.6484 | 12.2682 |
| 670 | 3.5670 | 2.3026 | 0.6455 | 12.2139 |
| 680 | 3.6679 | 2.1908 | 0.5973 | 11.3014 |
| 690 | 3.7647 | 1.9512 | 0.5183 | 9.8065 |
| 700 | 3.8572 | 2.0040 | 0.5196 | 9.8308 |
| 710 | 3.9453 | 2.0807 | 0.5274 | 9.9786 |
| 720 | 4.0290 | 1.7240 | 0.4279 | 8.0962 |
| 730 | 4.1083 | 1.9557 | 0.4760 | 9.0073 |
| 740 | 4.1831 | 2.1013 | 0.5023 | 9.5046 |
| 750 | 4.2534 | 1.7796 | 0.4184 | 7.9164 |
| 760 | 4.3193 | 1.2990 | 0.3007 | 5.6904 |
| 770 | 4.3808 | 1.8695 | 0.4268 | 8.0747 |
| 780 | 4.4380 | 1.7737 | 0.3997 | 7.5623 |
| | 100.0000 | 100.00 | | |

FIG. 6C

| Wavelength | Black Body Source | Normal Daylight | Optimal Filter | Optimal Filter Norm. |
|---|---|---|---|---|
| 380 | 0.1817 | 0.3954 | 2.1760 | 74.0524 |
| 390 | 0.2257 | 0.4805 | 2.1287 | 72.4430 |
| 400 | 0.2765 | 0.7837 | 2.8348 | 96.4693 |
| 410 | 0.3343 | 0.9822 | 2.9385 | 100.0000 |
| 420 | 0.3994 | 1.0955 | 2.7431 | 93.3498 |
| 430 | 0.4719 | 1.0853 | 2.2999 | 78.2666 |
| 440 | 0.5519 | 1.4764 | 2.6751 | 91.0365 |
| 450 | 0.6394 | 1.8096 | 2.8302 | 96.3147 |
| 460 | 0.7343 | 1.9464 | 2.6508 | 90.2078 |
| 470 | 0.8363 | 2.0336 | 2.4315 | 82.7475 |
| 480 | 0.9453 | 2.1784 | 2.3043 | 78.4189 |
| 490 | 1.0610 | 2.1871 | 2.0615 | 70.1539 |
| 500 | 1.1828 | 2.3533 | 1.9896 | 67.7063 |
| 510 | 1.3105 | 2.4243 | 1.8499 | 62.9538 |
| 520 | 1.4435 | 2.4980 | 1.7305 | 58.8893 |
| 530 | 1.5814 | 2.6752 | 1.6917 | 57.5691 |
| 540 | 1.7236 | 2.6893 | 1.5603 | 53.0979 |
| 550 | 1.8695 | 2.7706 | 1.4820 | 50.4326 |
| 560 | 2.0187 | 2.7464 | 1.3605 | 46.2991 |
| 570 | 2.1705 | 2.7144 | 1.2506 | 42.5595 |
| 580 | 2.3244 | 2.7864 | 1.1988 | 40.7958 |
| 590 | 2.4797 | 2.7297 | 1.1008 | 37.4614 |
| 600 | 2.6361 | 2.9350 | 1.1134 | 37.8894 |
| 610 | 2.7929 | 3.0466 | 1.0908 | 37.1223 |
| 620 | 2.9496 | 3.0913 | 1.0480 | 35.6651 |
| 630 | 3.1058 | 3.0337 | 0.9768 | 33.2405 |
| 640 | 3.2609 | 3.2283 | 0.9900 | 33.6902 |
| 650 | 3.4146 | 3.1729 | 0.9292 | 31.6220 |
| 660 | 3.5664 | 3.3322 | 0.9343 | 31.7967 |
| 670 | 3.7159 | 3.5569 | 0.9572 | 32.5751 |
| 680 | 3.8628 | 3.4690 | 0.8981 | 30.5617 |
| 690 | 4.0067 | 3.0181 | 0.7533 | 25.6342 |
| 700 | 4.1474 | 3.2241 | 0.7774 | 26.4553 |
| 710 | 4.2846 | 3.1914 | 0.7449 | 25.3483 |
| 720 | 4.4180 | 2.6378 | 0.5971 | 20.3183 |
| 730 | 4.5474 | 2.9492 | 0.6485 | 22.0706 |
| 740 | 4.6727 | 3.1459 | 0.6733 | 22.9115 |
| 750 | 4.7937 | 2.6536 | 0.5536 | 18.8379 |
| 760 | 4.9103 | 1.9751 | 0.4022 | 13.6884 |
| 770 | 5.0223 | 2.8345 | 0.5644 | 19.2063 |
| 780 | 5.1297 | 2.6629 | 0.5191 | 17.6660 |
| | 100.0000 | 100.00 | | |

FIG. 6D

| Wavelength | Black Body Source | Normal Daylight | Optimal Filter | Optimal Filter Norm. |
|---|---|---|---|---|
| 380 | 0.1817 | 0.6977 | 3.8395 | 75.5424 |
| 390 | 0.2257 | 0.8511 | 3.7709 | 74.1937 |
| 400 | 0.2765 | 1.4051 | 5.0826 | 100.0000 |
| 410 | 0.3343 | 1.6106 | 4.8184 | 94.8027 |
| 420 | 0.3994 | 1.7111 | 4.2847 | 84.3017 |
| 430 | 0.4719 | 1.6480 | 3.4925 | 68.7153 |
| 440 | 0.5519 | 2.1330 | 3.8649 | 76.0426 |
| 450 | 0.6394 | 2.4874 | 3.8902 | 76.5403 |
| 460 | 0.7343 | 2.5835 | 3.5184 | 69.2259 |
| 470 | 0.8363 | 2.6052 | 3.1151 | 61.2890 |
| 480 | 0.9453 | 2.7120 | 2.8689 | 56.4452 |
| 490 | 1.0610 | 2.6225 | 2.4718 | 48.6337 |
| 500 | 1.1828 | 2.7299 | 2.3080 | 45.4102 |
| 510 | 1.3105 | 2.7554 | 2.1026 | 41.3686 |
| 520 | 1.4435 | 2.7703 | 1.9191 | 37.7589 |
| 530 | 1.5814 | 2.9122 | 1.8415 | 36.2321 |
| 540 | 1.7236 | 2.8739 | 1.6674 | 32.8067 |
| 550 | 1.8695 | 2.9186 | 1.5611 | 30.7155 |
| 560 | 2.0187 | 2.8526 | 1.4131 | 27.8027 |
| 570 | 2.1705 | 2.7880 | 1.2845 | 25.2732 |
| 580 | 2.3244 | 2.8219 | 1.2140 | 23.8865 |
| 590 | 2.4797 | 2.6675 | 1.0757 | 21.1644 |
| 600 | 2.6361 | 2.7871 | 1.0573 | 20.8023 |
| 610 | 2.7929 | 2.8324 | 1.0141 | 19.9531 |
| 620 | 2.9496 | 2.8260 | 0.9581 | 18.8503 |
| 630 | 3.1058 | 2.7314 | 0.8794 | 17.3031 |
| 640 | 3.2609 | 2.8210 | 0.8651 | 17.0208 |
| 650 | 3.4146 | 2.7301 | 0.7995 | 15.7308 |
| 660 | 3.5664 | 2.8022 | 0.7857 | 15.4593 |
| 670 | 3.7159 | 2.9397 | 0.7911 | 15.5654 |
| 680 | 3.8628 | 2.8293 | 0.7325 | 14.4113 |
| 690 | 4.0067 | 2.4938 | 0.6224 | 12.2462 |
| 700 | 4.1474 | 2.6145 | 0.6304 | 12.4030 |
| 710 | 4.2846 | 2.6510 | 0.6187 | 12.1737 |
| 720 | 4.4180 | 2.1934 | 0.4965 | 9.7681 |
| 730 | 4.5474 | 2.4689 | 0.5429 | 10.6823 |
| 740 | 4.6727 | 2.6421 | 0.5654 | 11.1250 |
| 750 | 4.7937 | 2.2326 | 0.4657 | 9.1633 |
| 760 | 4.9103 | 1.6465 | 0.3353 | 6.5973 |
| 770 | 5.0223 | 2.3666 | 0.4712 | 9.2711 |
| 780 | 5.1297 | 2.2339 | 0.4355 | 8.5681 |
| | 100.0000 | 100.00 | | |

FIG.6E

| Wavelength | Black Body Source | Normal Daylight | Optimal Filter | Optimal Filter Norm. |
|---|---|---|---|---|
| 380 | 0.1817 | 1.3968 | 7.6869 | 91.8542 |
| 390 | 0.2257 | 1.5276 | 6.7679 | 80.8729 |
| 400 | 0.2765 | 2.3135 | 8.3685 | 100.0000 |
| 410 | 0.3343 | 2.5577 | 7.6519 | 91.4358 |
| 420 | 0.3994 | 2.6122 | 6.5412 | 78.1640 |
| 430 | 0.4719 | 2.4236 | 5.1362 | 61.3750 |
| 440 | 0.5519 | 2.9323 | 5.3131 | 63.4895 |
| 450 | 0.6394 | 3.2721 | 5.1174 | 61.1504 |
| 460 | 0.7343 | 3.2947 | 4.4870 | 53.6178 |
| 470 | 0.8363 | 3.2123 | 3.8409 | 45.8974 |
| 480 | 0.9453 | 3.2422 | 3.4296 | 40.9825 |
| 490 | 1.0610 | 3.0433 | 2.8685 | 34.2772 |
| 500 | 1.1828 | 3.0587 | 2.5860 | 30.9009 |
| 510 | 1.3105 | 3.0154 | 2.3010 | 27.4952 |
| 520 | 1.4435 | 2.9313 | 2.0307 | 24.2654 |
| 530 | 1.5814 | 3.0125 | 1.9050 | 22.7636 |
| 540 | 1.7236 | 2.9207 | 1.6946 | 20.2493 |
| 550 | 1.8695 | 2.9108 | 1.5570 | 18.6048 |
| 560 | 2.0187 | 2.7976 | 1.3859 | 16.5605 |
| 570 | 2.1705 | 2.6952 | 1.2417 | 14.8381 |
| 580 | 2.3244 | 2.6799 | 1.1530 | 13.7776 |
| 590 | 2.4797 | 2.4813 | 1.0006 | 11.9569 |
| 600 | 2.6361 | 2.5183 | 0.9553 | 11.4156 |
| 610 | 2.7929 | 2.5070 | 0.8976 | 10.7263 |
| 620 | 2.9496 | 2.4539 | 0.8319 | 9.9412 |
| 630 | 3.1058 | 2.3306 | 0.7504 | 8.9668 |
| 640 | 3.2609 | 2.3421 | 0.7182 | 8.5826 |
| 650 | 3.4146 | 2.2394 | 0.6558 | 7.8369 |
| 660 | 3.5664 | 2.2447 | 0.6294 | 7.5212 |
| 670 | 3.7159 | 2.3026 | 0.6197 | 7.4045 |
| 680 | 3.8628 | 2.1908 | 0.5672 | 6.7773 |
| 690 | 4.0067 | 1.9512 | 0.4870 | 5.8191 |
| 700 | 4.1474 | 2.0040 | 0.4832 | 5.7741 |
| 710 | 4.2846 | 2.0807 | 0.4856 | 5.8029 |
| 720 | 4.4180 | 1.7240 | 0.3902 | 4.6630 |
| 730 | 4.5474 | 1.9557 | 0.4301 | 5.1392 |
| 740 | 4.6727 | 2.1013 | 0.4497 | 5.3736 |
| 750 | 4.7937 | 1.7796 | 0.3712 | 4.4361 |
| 760 | 4.9103 | 1.2990 | 0.2645 | 3.1612 |
| 770 | 5.0223 | 1.8695 | 0.3722 | 4.4482 |
| 780 | 5.1297 | 1.7737 | 0.3458 | 4.1319 |
| | 100.0000 | 100.00 | | |

FIG. 6F

LAMP FOR PRODUCING A DAYLIGHT SPECTRUM

FIELD OF THE INVENTION

A lamp assembly whose spectral output is substantially identical to natural daylight.

BACKGROUND OF THE INVENTION

Many attempts have been made to simulate natural daylight by artificial means. Some of the more successful devices for this purpose are described in applicant's U.S. Pat. Nos. 5,079,683, 5,083,252, and 5,282,115; the entire disclosure of each of these U.S. patents is hereby incorporated by reference into this specification.

The apparatus of U.S. Pat. No. 5,282,115 is illustrative of these prior art devices. This apparatus contains a light source and a single filter. The single filter is comprised of a color correcting filter material and a neutral density filter material. While the apparatus is adjusted, the spectral distribution of the light which passes through it varies continuously, but the brightness and/or irradiance of such light is substantially constant.

However, none of the devices of applicant's U.S. patents, and none of the prior art devices known to applicant, readily lend themselves for use in many commercial and residential settings. Thus, e.g., such prior art devices cannot readily be used in the dressing rooms of clothes stores, in jewelry stores, on the counters of cosmetic departments of department stores, in design studios, and the like.

Furthermore, none of these prior art devices known to applicant can be readily and effectively used to treat "seasonal affective disorder." This disorder, which is characterized by depression and often is also often characterized by fatigue, difficulties in concentrating, cravings for carbohydrates, and weight gain, is also often referred to as the "Winter blues." See, e.g., an article by Norman E. Rosenthal et al. entitled "Phototherapy for Seasonal Affective Disorder," Journal of Biological Rhythms, Volume 3, Number 2, 1988, pp. 101–120. Also see an article by Bosghos I. Yerevanian et al. entitled "Effects of Bright Incandescent Light on Seasonal and Nonseasonal Major Depressive Disorder," Psychiatry Research, 18, 355–364 (1986).

It is commonly agreed that "seasonal affective disorder" is caused by a deficiency of exposure to daylight. The devices used to treat this disorder, however, do not supply daylight to the patient.

Thus, for example, one such device is described in U.S. Pat. No. 4,911,166, which discloses a portable light delivery system which uses a point source of light (such as a high intensity halogen bulb) and a positive lens adapted to direct a large fraction of the light from the bulb directly into a patient's eyes. Not only is daylight not delivered by the device of this patent, but a patient must be fitted with such device in order to be treated.

It would be desirable to be able to equip an indoor environment with a lighting assembly which could provide daylight without the occupants having to actively or consciously attempt to be exposed to such daylight. Thus, it would be desirable to have a lamp assembly which could be used to provide daylight in such indoor environment.

To the best of applicant's knowledge, no such lamp assembly exists; and the prior art tends to teach that such assembly would be very difficult to produce.

Thus, e.g., U.S. Pat. No. 4,870,318 of Istvan Csanyi et al. discloses a projector lamp comprised of a light source and a mirror arranged in spaced arrangement to the light source. In referring to known light sources for emitting color light, the patentees state (at lines 10–13 of column 2) that "The afore-mentioned specifications show projector lamps equipped with a front filter and there isn't any known solution whereby projection of colour light would be possible without applying any front filter." Approximately one half of the light which is passed through such front filter generally will not be focused, and the color temperature of the output from such lamp will generally be lower than that produced when no such front filter is used.

U.S. Pat. No. 3,527,974 of Cooper describes another light source for producing a specified spectral output from an incandescent bulb. In the assembly of this patent, ". . . about 50% of the energy emitted from the lamp impinges upon the reflector thereby defining a light column having a color temperature of about 3300 K." (see lines 54–57 of column 5). The color temperature of the light spectra produced by the device of this patent is substantially lower than the color temperature of daylight, which is generally from about 4,100 to about 10,000 degrees Kelvin.

Furthermore, U.S. Pat. No. 4,839,553 teaches that, in general, "A lamp with a coated reflector, light source, and with or without a lens is limited in the range of hue and intensity to colors which are only slightly discernible from the unfiltered light of the light source" (see lines 56–59 of column 1).

Thus, none of the aforementioned patents is directed to a lamp for producing daylight. However, these patents do teach that, when one attempts to change the spectral characteristics of a bulb within a lamp, one must either use a front filter (with a concomitant loss in focus and intensity); and, even with the use of such filter, a spectral output with a relatively low color temperature will often be produced which is only slightly different from the spectral output of the bulb used in the device.

It is an object of this invention to provide a lamp with a coated reflector and light source which produces a spectral output which is substantially identical to daylight.

It is another object of this invention to provide a lamp with a coated reflector and light source which produces a spectral output with a color temperature of at least about 4,100 degrees Kelvin.

It is yet another object of this invention to provide a lamp with a coated reflector and light source which can be used with and in existing light fixtures.

It is yet another object of this invention to provide a lamp with a coated reflector and light source which is relatively inexpensive.

It is yet another object of this invention to provide a assembly which is comprised of at least one lamp with a coated reflector and light source, at least one conventional incandescent lamp, and a controller, which assembly will produce a range of spectral outputs.

SUMMARY OF THE INVENTION

In accordance with this invention, there is provided a lamp for producing a spectral distribution which is substantially identical to daylight color temperature. This lamp contains a filament which, when excited by electrical energy, emits radiant energy at least within the visible spectrum with wavelengths (l) from about 400 to about 700 nanometers. It also contains a reflector body with a surface to intercept and reflect such visible spectrum radiant energy; the filament is positioned within the reflector so that at least 50 percent of the visible spectrum radiant energy is directed towards the reflector surface. Furthermore, the reflector body has a coating on its surface from which the reflected radiance of each wavelength of the radiant energy directed towards the reflector surface when combined with the radiant energy not directed towards the reflector surface produces a total light output in substantial accordance with the formula $R(l)=[D(l)-[S(l)\times(1-X)]]/[S(l)\times X]$, wherein R(l) is the reflectance of the reflector coating for said wavelength, D(l) is the radiance of said wavelength for the daylight color temperature, S(l) is the total radiance of said filament at said wavelength, and X is the percentage of visible spectrum radiant energy directed towards said reflector surface.

BRIEF DESCRIPTION OF THE DRAWINGS

The present invention will be more fully understood by reference to the following detailed description thereof, when read in conjunction with the attached drawings, wherein like reference numerals refer to like elements, and wherein:

FIGS. 6A, 6B, 6C, 6D, 6E, and 6F are each a table specifying, for different artificial light source conditions, the properties of the reflector which should be used for a specified source and desired output;

DESCRIPTION OF THE PREFERRED EMBODIMENTS

Figure 1:
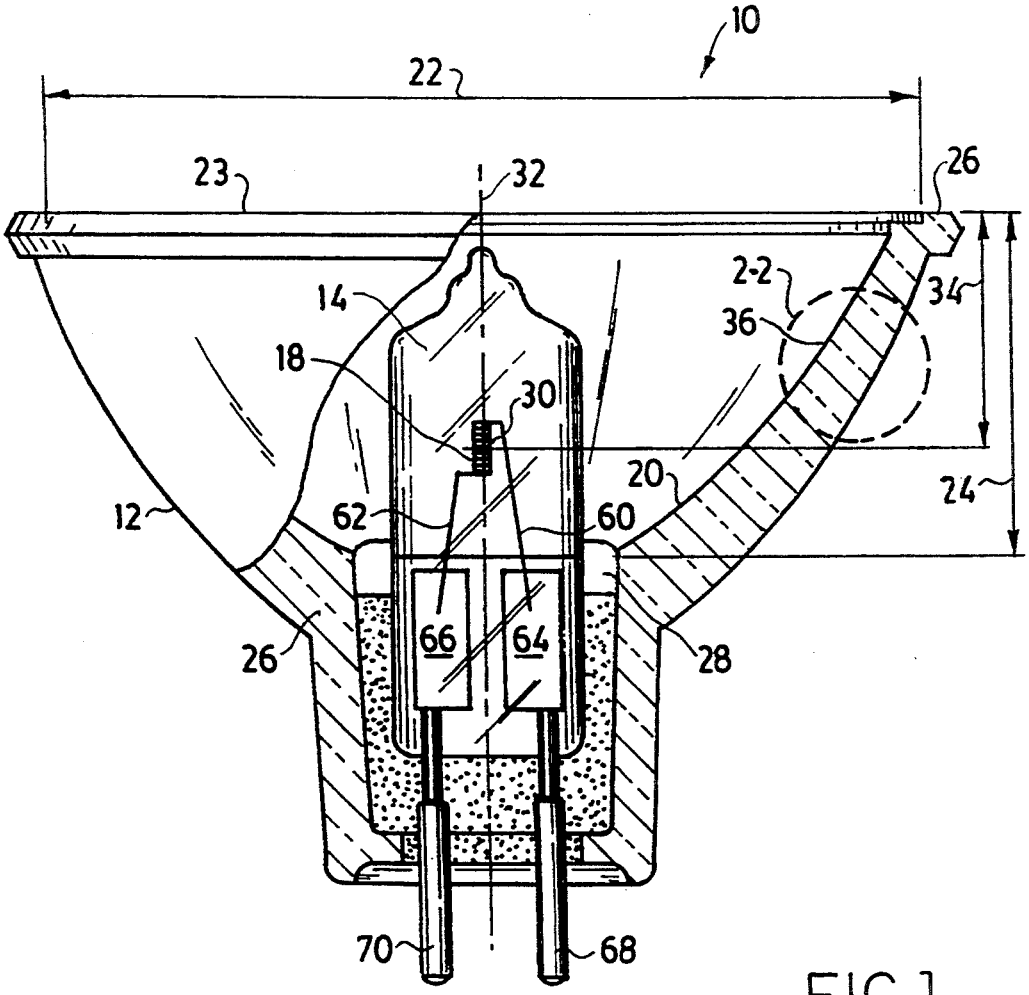
FIG. 1 is a sectional view of one preferred embodiment of the lamp assembly of this invention.

FIG. 1 is a sectional view of one incandescent lamp and reflector unit 10 according to the invention. Referring to FIG. 1, it will be seen that unit 10 is comprised of a reflector 12, an incandescent lamp bulb 14 secured and mounted in reflector 12 through the base 16 of reflector 12, and a filament 18 disposed within lamp bulb 14.

As is known to those skilled in the art, a reflector is a type of surface or material used to reflect radiant energy. The reflector 12 used in unit 10 preferably contains arcuate surfaces 20.

The reflector used in the lamp of this invention preferably has certain specified optical characteristics.

In the first place, the reflector body has a surface which intercepts and reflects visible spectrum radiant energy in the range of 400 to 700 nanometers. The filament 18 used in applicant's lamp assembly is so positioned within the reflector so that at least about 50 percent of the visible spectrum radiant energy is directed towards the reflector surface. It is preferred that filament 18 be positioned in order that at least about 60 percent of the visible spectrum radiant energy is directed towards the reflector surface. In most of the preferred embodiments, it is preferred that filament 18 be positioned so that at least about 90 percent of the visible spectrum radiant energy is directed towards the reflector surface.

Furthermore, the reflector body has a coating on its surface from which the reflected radiance of each wavelength of the visible spectrum radiant energy directed towards the reflector surface when combined with the visible spectrum radiant energy not directed towards the reflector surface produces a total light output in substantial accordance with the formula $R(l)=[D(l)-[S(l)\times(1-X)]]/[S(l)\times X]$, wherein R(l) is the reflectance of the reflector coating for said wavelength, D(l) is the radiance of said wavelength for the daylight color temperature, S(l) is the total radiance of said filament at said wavelength, and X is the percentage of visible spectrum radiant energy directed towards said reflector surface.

In one preferred embodiment, and by way of illustration and not limitation, the reflector 12 used in applicant's incandescent lamp has a specified set of reflectance properties. In this embodiment, the characteristics of such reflector are such that, on average, from about 80 to about 90 percent of all of the radiant energy with a wavelength between about 400 and 500 nanometers is reflected, on average, at least from about 50 to about 60 percent of all of the radiant energy with a wavelength between about 500 and 600 nanometers is reflected, on average at least about 40 to about 50 percent of all of the radiant energy with a wavelength between about 600 and 700 nanometers is reflected, and on average at least about 10 to about 20 percent of all of the radiant energy with a wavelength between about 700 and 800 nanometers is reflected.

In one preferred embodiment, the spectral reflectance curve produced by reflector 12 is generally downwardly sloping between wavelengths of from about 400 to about 780 nanometers and generally upwardly sloping between wavelengths of from about 380 to about 400 nanometers.

In general, and on average, and in this preferred embodiment, the average amount of light reflected between wavelengths of from 400 to 500 nanometers exceeds the amount of light reflected between wavelengths of 500 to 600 nanometers, which in turn exceeds the amount of light reflected between wavelengths of 600 to 700 nanometers, which in turn exceeds the amount of light reflected between wavelengths of 700 to 800 nanometers.

In one preferred embodiment, reflector 12 has a concave inner surface such as, e.g., concave inner surface 20. As is known to those skilled in the art, the term concave describes a hollow curved surface which is curved inwardly. Such a hollow curved surface may have a substantially spherical shape (not shown). In the preferred embodiment illustrated in FIG. 1, the hollow curved inner surface 20 has a substantially parabolic shape which functions as a paraboloid mirror.

As is known to those skilled in the art, a paraboloidal mirror has the form of a paraboloid of revolution. The paraboloidal mirror may have only a portion of a paraboloidal surface through which the axis does not pass, and is known as an off-axis paraboloidal mirror. All axial, parallel light rays are focused at the focal point of the paraboloid without spherical aberration, and conversely all light rays emitted from an axial source at the focal point are reflected as a bundle of parallel rays without any spherical aberration, Typical reflector 12's which may be used in this invention are readily commercially available. Thus, by way of illustration, and with reference to the "Optics Guide 5" (published by Melles Griot, 1770 Kettering Street, Irvine, Calif., one may purchase the concave spherical reflectors discussed on pages 12–16, 12–17, and 12–18 of such publication.

In the preferred embodiment illustrated in FIG. 1, reflector 12 preferably has a width 22 which is less than about 200 millimeters and more preferably is from about 30 to about 50 millimeters. The preferred reflector 12 has a depth 24 (as measured from top surface 26 to the vertex 28) of less than about 200 millimeters and, more preferably, from about 15 to about 25 millimeters.

The focal point of reflector 12, which is also known as its "principal point of focus," is the point to which incident parallel light rays converge or from which they diverge after being acted upon by a lens or mirror. The focal point of a reflector may be determined by well known, conventional means. See, for example, U.S. Pat. Nos. 5,105,347, 5,084,804, 5,047,902, 5,045,982, 5,037,191, 5,010,272, and the like. The disclosure of each of these U.S. patents is hereby incorporated by reference into this specification.

Referring again to FIG. 1, the focal point 30 of reflector 12 is located at about position 30. As will be apparent to those skilled in the art, in applicant's lamp assembly filament 18 is located at focal point 30.

In the preferred embodiment illustrated in FIG. 1, the focal point 30 is preferably located substantially below top surface 26 of reflector 12 such that the distance 34 between focal point 30 and top surface 26 is at least about 50 percent of the depth 24 of reflector 12 and, more preferably, is at least about 60 percent of the depth 24 of reflector 12.

As will be apparent to those skilled in the art, as the depth 24 of reflector 12 increases, the reflector 12 will increase the percentage of visible spectrum radiant energy which is intercepted by the reflector surface. Referring to the formula $R(l)=[D(l)-[S(l)\times(1-X)]]/[S(l)\times X]$, X will increase as the depth 24 of reflector 12 increases.

Referring again to FIG. 1, it will be seen that reflector 12 has an axis of symmetry 32 which, in the case of a parabolic reflector (such as that illustrated in FIG. 1) is the axis of the parabola. As is known to those skilled in the art, the axis (or axis of symmetry) of a curved structure is a straight line, real or imagined, passing through a structure and indicating its center; it is a line so positioned that various portions of an object are located symmetrically in relation to the line.

Referring again to FIG. 1, it will be seen that filament 18 is substantially aligned with and substantially parallel to axis of symmetry 32. This will be discussed in more detail later in this specification by reference to FIG. 8.

Figure 2:
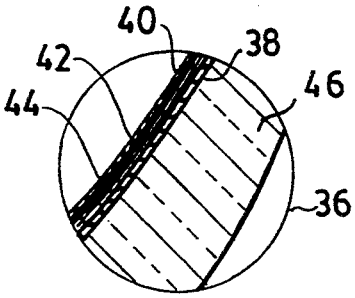
FIG. 2 is an enlarged sectional view of a portion of the reflector used in the assembly of FIG. 1.

Referring again to FIG. 1, and also to FIG. 2, it will be seen that the reflecting surface 20 of reflector 12 is covered with a layer system 36 which is shown in more detail in FIG. 2.

Referring to FIG. 2, it will be seen that layer system 36 is comprised of at least about five layers 38, 40, 42, and 44 which are coated upon substrate 46.

Substrate 46 preferably consists essentially of a transparent material such as, e.g., plastic or glass. As is used this specification, the term transparent refers to the property of transmitting radiation without appreciable scattering or diffusion.

In one preferred embodiment, the transparent substrate material is transparent borosilicate glass. As is known to those skilled in the art, borosilicate glass is a soda-lime glass containing approximately boric oxide which has a low expansion coefficient and a high softening point; it generally transmits ultraviolet light in higher wavelengths.

Borosilicate glasses are well known to those skilled in the art and are described, e.g., in U.S. Pat. Nos. 5,017,521 (borosilicate glass containing cerium oxide), 4,944,784, 4,911,520, 4,909,856, 4,906,270 (boroscilicate glass or glass ceramic), 4,870,034, 4,830,652, and the like. The disclosure of each of these U.S.-patents is hereby incorporated by reference into this specification.

Borosilicate glasses, and reflector substrates of borosilicate glass with and without multifaceted substrates, are readily commercially available and may be obtained, e.g., from Corning Incorporated of Corning, N.Y. Thus, referring to Corning publication MB-EG-90, entitled "Specialty Glass and Glass Ceramic Materials," one may use glass product 7254 ("Borosilicate"), 7720 ("Soda Lead Borosilicate"), 7740 ("Soda Borosilicate"), and the like; the glasses are described on page 6.1 of such catalog.

Referring again to FIG. 2, layer 38 is contiguous with layer 40, which in turn is contiguous with layer 42, which in turn is contiguous with layer 44. Although a minimum of at least about five such contiguous coatings must be deposited onto substrate 46, it is preferred to have at least twenty such contiguous coatings.

In one preferred embodiment, each of layers 38, 40, 42, and 44 is a dielectric material (such as magnesium fluoride, silicon oxide, zinc sulfide, and the like) which has an index of refraction which differs from the index of refraction of any other layer adjacent and contiguous to such layer. In general, the indices of refraction of layers 38, 40, 42, and 44 range from about 1.3 to about 2.6. Each of the layers is deposited sequentially onto the reflector as by vapor deposition or other well know methods.

In accordance with the procedure described below, a reflector 12 is produced with a specified spectral output. The spectral output is calculated and determined by the method described below with reference to the spectra of daylight, and the spectra of the bulb used in the lamp 10.

The spectra of daylight is well-known and is discussed, e.g., in applicant's U.S. Pat. Nos. 5,079,683, 5,083,252, and 5,282,115; and one example of such spectra is illustrated in FIG. 3.

Figure 3:
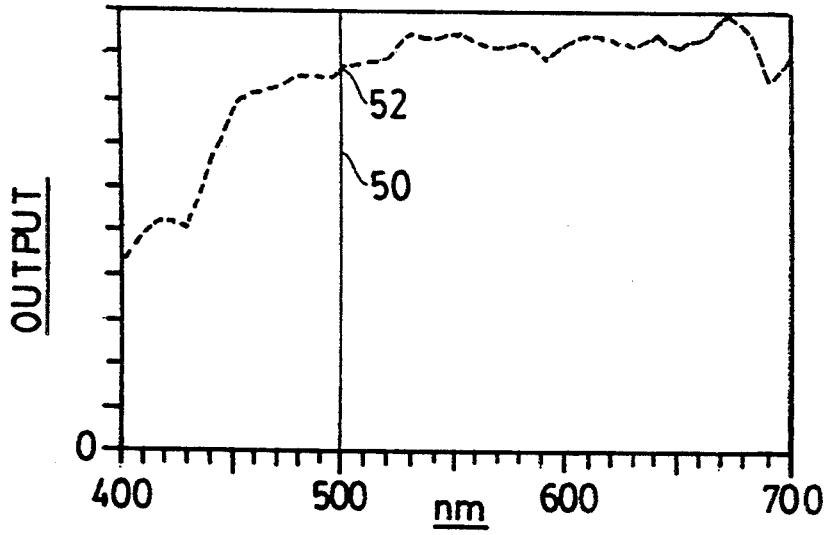
FIG. 3 is a graph of an example of the spectra of daylight.
Figure 4:
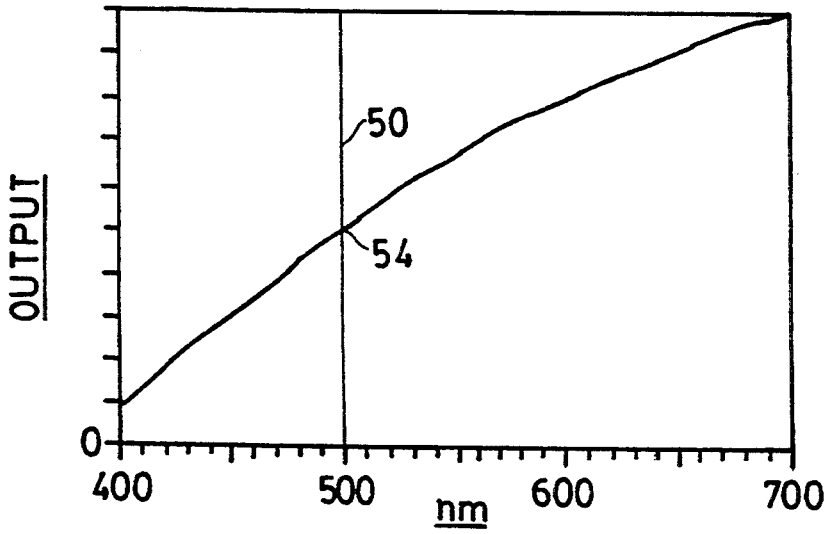
FIG. 4 is a graph of an example of the spectral output of an incandescent lamp.

Referring to FIG. 3, it will be seen that a graph plotting wavelength (on the X axis) versus radiance, in watts (on the Y axis) is plotted to give the spectra of daylight. FIG. 4 is a similar graph for incandescent bulb 18; as is known to those skilled in the art, the radiance of any incandescent bulb can readily be determined at any particular wavelength.

For any particular wavelength, the radiance at that wavelength can be determined for both daylight and the lamp used. Thus, referring to FIGS. 3 and 4, line 50 can be drawn at a wavelength of 500 nanometers to determine such radiances.

Line 50 intersects the graph of the daylight spectra at point 52 and indicates that, at a wavelength of 500 nanometers, such daylight spectra has a radiance of 0.5 watts.

Line 50 intersects the graph of the spectra of lamp 18 at point 54 and indicates that, a wavelength of 500 nanometers, such lamp has a radiance of 0.5 watts.

The reflector 12 is comprised of a reflector body with a coating on the surface of such body from which the reflected radiance of each wavelength of said visible spectrum radiant energy directed towards said reflector surface when combined with the visible spectrum radiant energy not directed towards said reflector surface produces a total light output in substantial accordance with the formula $R(l)=[D(l)-[S(l)\times(1-X)]]/[S(l)\times X]$, wherein R(l) is the reflectance of the reflector coating for said wavelength, D(l) is the radiance of said wavelength for the daylight color temperature, S(l) is the total radiance of said filament at said wavelength, and X is the percentage of visible spectrum radiant energy directed towards said reflector surface.

Figure 5:
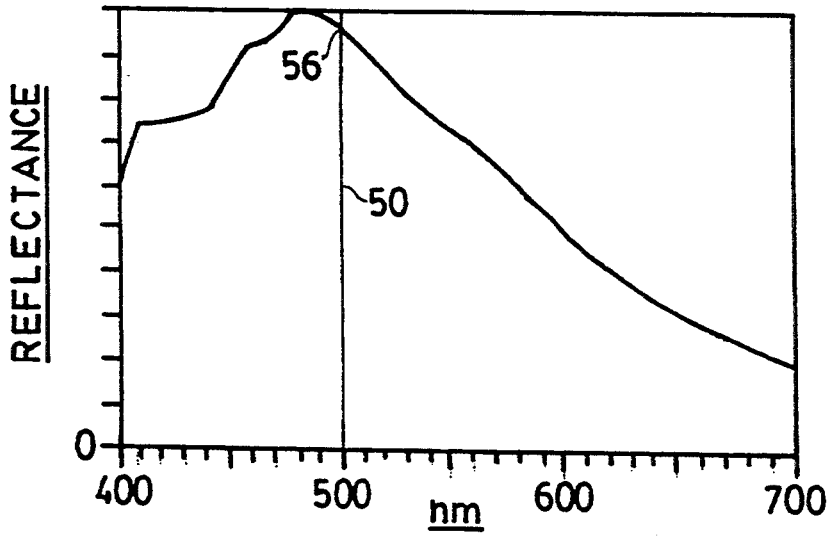
FIG. 5 is a graph of the reflectance of a reflector.

With the use of such formula, and for any particular wavelength, one can determine the desired reflectance for reflector 12. This value may be plotted at point 56 (see FIG. 5).

By such a method, for each wavelength, a graph can be constructed showing the desired reflectance for the reflector 12. Such a typical graph is shown as FIG. 5. It will be appreciated that FIGS. 3, 4, and 5, and the data they contain, do not necessarily reflect real values but are shown merely to illustrate a method of constructing the desired values for the reflector 12.

By way of illustration and not limitation, and in accordance with the aforementioned method, the desired reflectance values for a parabolic reflector with a borosilicate substrate were calculated at various wavelengths and for various conditions.

The Table presented in FIG. 6A discloses the desired reflectance values for a reflector using a bulb with a color temperature of either about 2,800 or about 3,100 degrees Kelvin and 100 percent of the light is reflected, when one desires a daylight color temperature of about 5,100 degrees Kelvin.

Referring to Table 6A, a series of values of presented for wavelengths from 380 nanometers to 780 nanometers, in 10 nanometer increments.

For each such wavelength, the radiant exitance is calculated and presented for the specified "Black Body Source." As is known to those skilled in the art, the radiant exitance is the radiant flux per unit area emitted from a surface.

The radiant exitance may be calculated in accordance with the well-known Planck Radiation Law; see, e.g., page 1–13 of Walter G. Driscoll et al.'s "Handbook of Optics" (McGraw Hill Book Company, New York, 1978). Also see U.S. Pat. Nos. 4,924,478, 5,098,197, and 4,974,182, the disclosures of each of which is hereby incorporated by reference into this specification.

For each wavelength, the relative spectral irradiance may be calculated for normal daylight conditions at a specified color temperature, in accordance with the well-known "Relative Spectral Irradiance Distribution" equation which is disclosed, e.g., on page 9–14 of said "Handbook of Optics." As is known to those skilled in the art, spectral irradiance is the irradiance per unit wavelength interval at a given wavelength, expressed in watts per unit area per unit wavelength interval. Referring again to FIG. 6A, for each wavelength, the relative spectral irradiance is entered under the "Normal Daylight" column.

The reflectance for the "optimal filter" design, at any particular wavelength, may then be calculated from the formula $R(l)=[D(l)-[S(l)\times(1-X)]]/[S(l)\times X]$. R(l) is the "Optimal Filter" reflectance. D(l) is the relative spectral irradiance value entered under the "Normal Daylight" column. S(1) is the radiant exitance entered under the "Black Body Source" column.

The value of X may be readily calculated by ray tracing (the mathematical calculation of the path traveled by a ray through an optical component or system). Ray tracing is described, e.g., on pages 2–11 to 2–16 and 2–66, 2–68, 2–69, and 2–72 to 2–76 of said "Handbook of Optics."

With the values of X, D(l), and S(l), the value of the desired reflectance ("Optimal Filter") may then be readily calculated. The "Optical Filter Norm." may then be calculated by determining the maximum "Optical Filter" value, dividing that into the value for any particular wavelength, and multiplying by 100.

FIG. 6A presents the values obtained when the color temperature of the desired daylight 5,000 degrees Kelvin and the color temperature of the source is 3,100 degrees Kelvin. FIG. 6B presents the values obtained when the color temperature of the desired daylight 4,100 degrees Kelvin and the color temperature of the source is 3,100 degrees Kelvin. FIG. 6C presents the values obtained when the color temperature of the desired daylight 6,500 degrees Kelvin and the color temperature of the source is 3,100 degrees Kelvin. FIG. 6D presents the values obtained when the color temperature of the desired daylight 4,100 degrees Kelvin and the color temperature of the source is 2,800 degrees Kelvin. FIG. 6E presents the values obtained when the color temperature of the desired daylight 5,000 degrees Kelvin and the color temperature of the source is 2,800 degrees Kelvin. FIG. 6F presents the values obtained when the color temperature of the desired daylight 6,500 degrees Kelvin and the color temperature of the source is 2,800 degrees Kelvin.

Each of FIGS. 6A–6F assumes a 100 percent light reflection (X=1). For reflectances less than 100 percent, the values are similarly calculated, as for example if in FIG. 6A the light incident upon the reflector were 90 percent, the reflectance (R) at 380 nanometers would be determined by $R(380=[D(380)-[S(380)\times[1-0.9]]]/[S(380)\times 0.9]=[0.6977-[0.3072\times 0.1]]/[0.3072\times 0.9]=2.2124$. This process is repeated for each wavelength. The maximum R value is then determined, and then the "Optical Filter Norm." is determined in accordance with the method described elsewhere in this specification.

As is apparent to those skilled in the art, there are many companies which, when presented with a set of desired reflectance values at specified wavelengths, the substrate to be used, and the dimensions of the desired reflector, can custom design a coating for a reflector which, when coated, will have the desired shape and size and produce the desired reflectance values. Thus, by way of illustration and not limitation, such companies include Action Research of Acton, Mass., Bausch & Lomb Corporation of Rochester, N.Y., Evaporated Coatings Inc. of Willow Grove, Melles Griot Company of Irvine, Calif., Pa., OCLI Company of Santa Rosa, Calif., and Tyrolift Company Inc. of West Babylon, N.Y.

As is known to those skilled in the art, a multiplicity of daylight spectra exist. What characterizes all of such spectra, however, is that each of them contain a relatively equal amount of all colors across the spectrum. Applicant's device may be used to simulate any daylight spectra.

Figure 7:
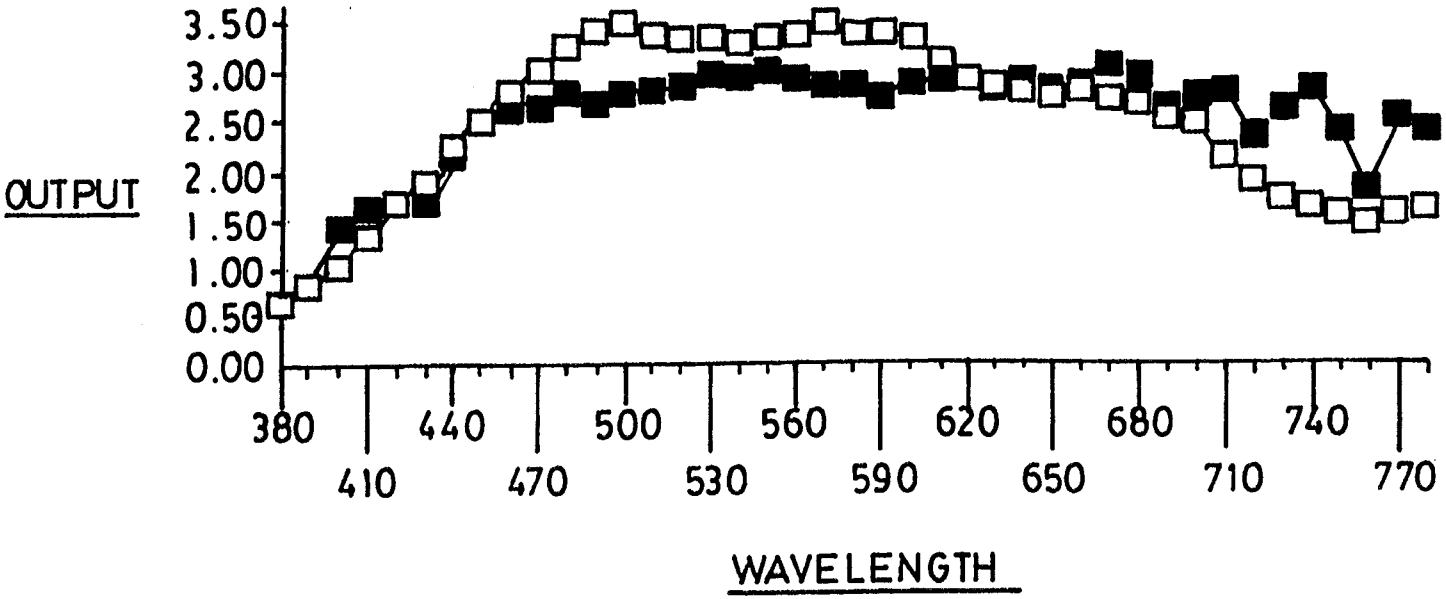
FIG. 7 is a graph of the actual output of a lamp assembly produced from the data of FIG. 6 compared with the actual daylight.

FIG. 7 is a graph of the output of a lamp assembly made with a reflector with the reflectance properties of FIG. 6A, and in accordance with the instant invention. For each wavelength, the output of daylight (black box value) and lamp 10 (white box value) were plotted. It will be noted that, across the spectrum, there is a substantial correlation between these values. The values are not identical, but they are substantially identical.

Assuming at least a 90 percent of the visible light incident upon the reflector 12, the total light output of lamp 10 will comprise at least 50 percent of the visible light emitted by the filament 12.

As used in this specification, the term substantially identical refers to a total light output which, at each of the wavelengths between about 400 and 700 nanometers on a continuum, is within about 30 percent of the D(1) value determined by the aforementioned formula and wherein the combined average of all of said wavelengths is within about 10 percent of the combined D(1) of all of said wavelengths.

Referring again to FIGS. 1 and 2, it is preferred that, at different points on reflector 12, the thickness of the coatings system 36 vary and that such coating system 36 not have a uniform thickness across the entire surface of the reflector 12.

In one preferred embodiment, not shown, the coated interior surface 20 of reflector 12 is multi-faceted. As is known to those skilled in the art, a facet is any part of an intersecting surface that constitutes an area of geographic study. Multi-faceted surfaces are well known to those skilled in the art and are described, e.g., in U.S. Pat. Nos. 4,917,447, 4,893,132, and 4,757,513. The disclosure of each of these patents is hereby incorporated by reference into this specification.

Figure 8:
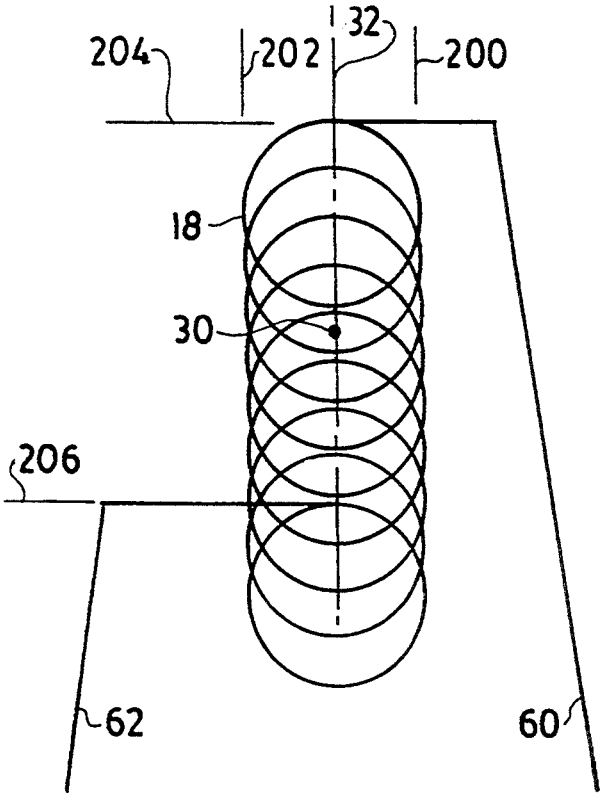
FIG. 8 is a sectional view of the filament used in the assembly of FIG. 1.

FIG. 8 is a partial sectional view of filament 18 within bulb 14 from which details of the bulb 14 and the reflector 12 have been omitted for the sake of simplicity. Referring to FIG. 8, it will be seen that filament 18 is substantially centrally located on focal point 30 and is aligned with the axis of symmetry of reflector 12 (see FIG. 1). Filament 18 is connected via wires 60 and 62 to electrical connecting tabs 64 and 66, and thence to pins 68 and 70 (see FIG. 1), which may be plugged into an electrical socket, not shown.

Referring again to FIG. 8, filament 18 preferably is constructed or comprised of tungsten. These type of filaments are well known to those skilled in the art. Thus, e.g., may use one or more of the filaments described in U.S. Pat. Nos. 4,857,804 (tungsten-halogen lamp), 4,998,044, 4,959,586, (filament with light-emitting section), 4,923,529 (heat treated tungsten filament), 4,839,559, and the like. The disclosure of each of these patents is hereby incorporated by reference into this specification.

As will be apparent to those skilled in the art, an incandescent bulb may readily be produced with a specified filament and filament geometry by conventional means. Thus, e.g., one may use the method of U.S. Pat. Nos. 5,037,342 (quartz halogen lamp), 4,876,482 (a halogen incandescent lamp), and the like.

FIG. 8 illustrates one preferred means of mounting a filament 18 within a lamp (not shown in FIG. 8). Referring to FIG. 8, it will be seen that filament 18 will be emitting radiation around its entire surface. A first portion of such radiation will be emitted between imaginary lines 200 and 202, and a second portion of such radiation will be emitted between imaginary lines 204 and 206. It will be apparent to those skilled in the art that the second portion of such radiation substantially exceeds the first portion of such radiation. Thus, it is preferred to orient filament 18 so that it is substantially parallel to the axis of rotation 32 of the reflector 12 (not shown).

Bulb 14 preferably has a specified degree of illumination per watt of power used. It is preferred that, for each watt of power used, bulb 14 produce at least about 80 candelas of luminous intensity. As is known to those skilled in the art, an candela is one sixtieth the normal intensity of one square centimeter of a black body at the solidification temperature of platinum. A point source of one candela intensity radiates one lumen into a solid angle of one steradian.

Means for producing bulbs which provide at least about 80 candelas of luminous intensity per watt are well known to those skilled in the art. Thus, e.g., such bulbs may be produced to desired specifications by bulb manufacturers such as, e.g., Sylvania Corporation.

It is preferred that the high-intensity bulb 14 be a high-intensity halogen bulb. Such high-intensity halogen light sources may be obtained from manufacturers such as, e.g., Carley Lamps, Inc. of Torrance, Calif., Dolan-Jenner Industries, Inc. of Woburn, Mass., the General Electric Corporation of Cleveland, Ohio, Welch-Allyn Company of Skaneateles Falls, N.Y., and the like. Many other such manufacturers at listed on pages 467–468 of "The Photonics Buyers' Guide," Book 2, 37th International Edition, 1991 (Laurin Publishing Company, Inc., Berkshire Common, Pittsfield, Mass.).

Referring again to FIG. 1, and in the preferred embodiment illustrated therein, it will be seen that lamp assembly 10 is preferably comprised of cover slide 23 which, preferably, consists essentially of transparent material such as, e.g., glass. Cover slide 23 is preferably at least about 1.0 millimeter thick and may be attached to reflector 12 by conventional means such as, e.g., adhesive.

As will be apparent to those skilled in the art, the function of cover slide 23 is to prevent damage to a user in the unlikely event that lamp assembly 10 were to explode. Additionally, if desired, cover slide 23 may be coated and, in this case, may be also be used to filter ultraviolet radiation.

Figure 9:
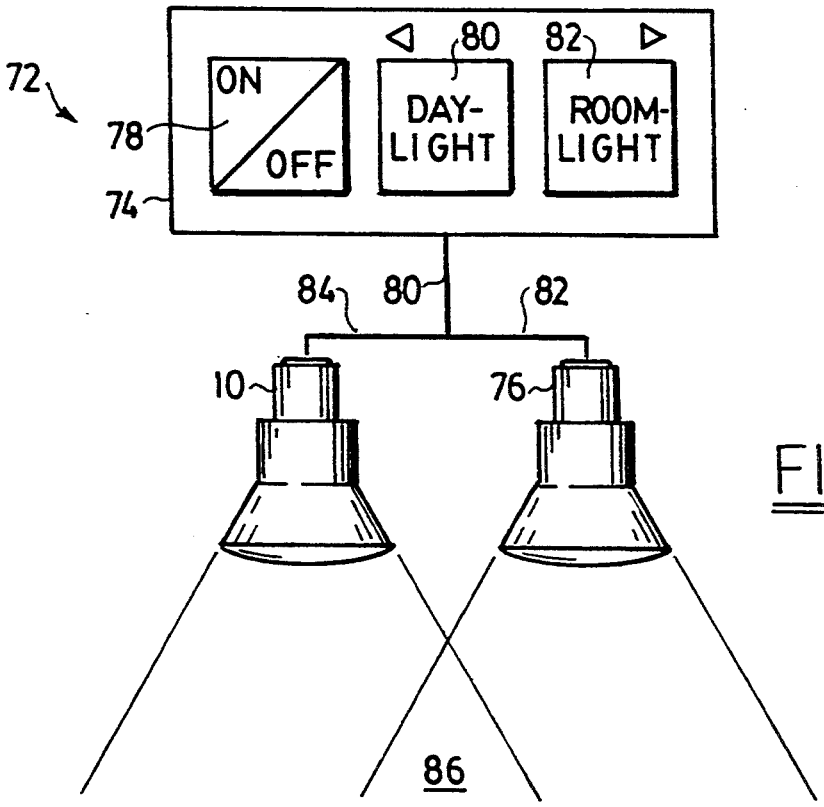
FIG. 9 is a schematic of a lighting assembly comprised of the lamp assembly of FIG. 1.

FIG. 9 is a schematic representation of a lamp assembly of the instant invention. Referring to FIG. 9, it will be seen that lamp assembly 72 is comprised of controller 74 which is electrically connected to both lamp 10 and lamp 76 by means of wires 80, 82, and 84.

Lamp 76 is preferably a standard incandescent lamp whose spectral output differs from that of lamp 10 but whose luminous intensity does not. These incandescent lamps are very well known to those skilled in the art and are described, e.g., in U.S. Pat. Nos. 5,177,396, 5,144,190, 4,315,186, 4,870,318, 4,998,038, and the like.

The disclosure of each of these patents is hereby incorporated by reference into this specification.

In one embodiment, incandescent bulb 76 is an MR-16 bulb sold by the Sylvania Company.

It will be apparent to those skilled in the art that, although only one lamp 10 and one lamp 76 are illustrated in FIG. 9, many such lamps may be connected to and controlled by controller 74. The function of controller 74 is to vary the amount of energy, and the time when such energy is delivered, which is passed from it to each of lamps 10 and 76. Thus, e.g., controller 74 is equipped with an on—off switch 78, a daylight switch 80, and a roomlight switch 82.

The on-off switch 78 switches the lamps 10 and 76 on and off. The daylight switch 80 can increase the output of lamp 10 while decreasing the output of lamp 76, so that the color temperature at surface 86 will increase while maintaining a relatively foot-candle level of irradiance. By comparison, while keeping the irradiance substantially constant, switch 82 decreases the output of lamp 10 while increasing the output of lamp 76. As will be apparent to those skilled in the art, the effect of this arrangement is substantially similar to the effects obtained with the devices of applicant's U.S. Pat. Nos. 5,282,115, 5,083,252, and 5,079,683, the disclosures of which are hereby incorporated by reference into this specification.

Many means for so controlling lamps 10 and 76 will be apparent to those skilled in the art. Such means are illustrated, for example, in U.S. Pat. Nos. 3,794,828, and 5,175,477 the entire disclosures of each of which is hereby incorporated by reference into this specification.

Figure 10:
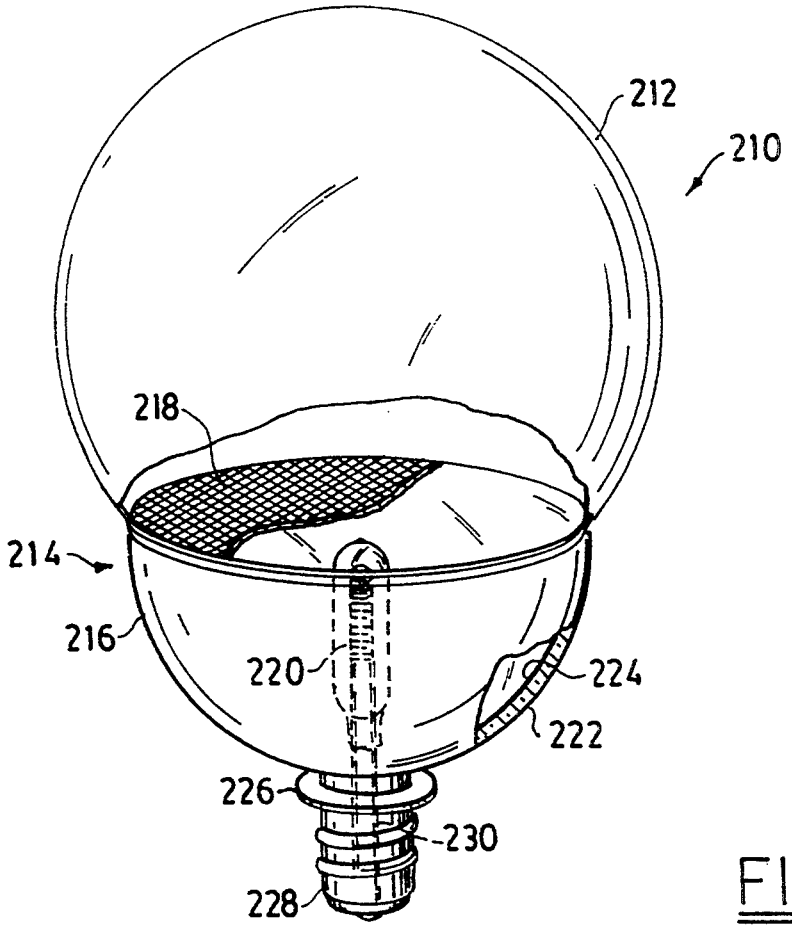
FIG. 10 is an alternate embodiment of the invention.

FIG. 10 is a schematic representation of yet another preferred lamp of this invention. Referring to FIG. 10, it will be seen that lamp assembly 210 is comprised of a reflector and bulb assembly 214.

The reflector and bulb assembly 214 comprises reflector 216. In the preferred embodiment illustrated, reflector 216 preferably has a concave, non-parabolic shape adapted, in accordance with the claimed invention, to redirect light towards a primary diffuser cover slide 218, or to a diffusing globe 212, or both; in this embodiment, the non-parabolic shape may preferably be spherical as long as the light source is positioned to reflect light according to the invention. Filament 220 may be oriented substantially parallel to the axis of symmetry of the reflector 216, or substantially perpendicular thereto (not shown). The exterior surface 220 of reflector 216 is coated with a radiation absorber coating 222.

As will be apparent to those skilled in the art, radiant energy emitted from filament 220 which passes through dielectric coating 224 will be absorbed by coating 222 and be converted to thermal energy; this heat energy, if necessary, will be dissipated by use of heat dissipating fins 226.

The lamp 210 may be attached to a source of electrical energy by a screw-in socket 228. Alternatively, it may be plugged into such energy source by a two-pin plug.

As will be apparent to those skilled in the art, the lamp 210 may be used where one desires diffuse daylight lighting. Thus, e.g., one may use such lamp in a light fixture in a living room.

It will be apparent to those skilled in the art that controller 74 (or other similar control means) may be used in conjunction with one or more lamps 10 and one or more lamps 76 to produce a spectral distribution of substantially constant brightness and/or irradiance while changing from an incandescent to a daylight situation, or vice versa. It will also be apparent that many such arrangements of lamps 10 and 76 may be used with controller 74.

Figure 11:
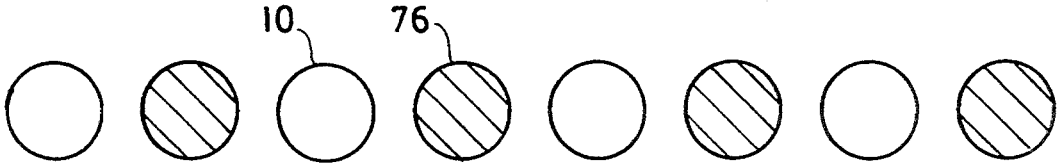
FIG. 11 is a representation of another preferred lighting assembly comprised of the lamp assembly of FIG. 1 and/or FIG. 10.

One such arrangement of lamps 10 and 76 is illustrated in FIG. 11. As will be apparent to those skilled in the art, such an arrangement may be used with a dual-track low-voltage lighting system. Such a lighting system is well known to those skilled in the art. See, e.g., the Times Square Lighting catalog, which is published by the Sales and Manufacturing Division of Times Square Lighting, Industrial Park, Route 9W, Stony Point, N.Y. Single track systems (see FIG. 12) are sold as products L002, L004, and L008 by this company. Dual track systems (see FIG. 11) are sold as products TS2002, TS2004, etc. by this company. Fixtures which can be used with either the single or dual track systems are sold Gimbal Rings (TL0121), Round Back Cylinders (TL0108), Cylinders (TL0312), Asteroid (TH0609), and the like.

Figure 12:
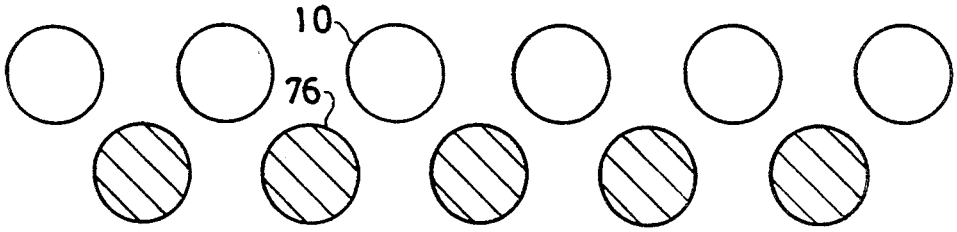
FIG. 12 is a representation of yet another preferred lighting assembly comprised of the lamp assembly of FIG. 1.

Another such arrangement of lamps 10 and 76 is illustrated in FIG. 12. This latter arrangement may be used with a single track low-voltage lighting system such as the one described above.

As will be apparent to those skilled in the art, many other such arrangements are possible.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. An integral lamp for producing a spectral light distribution which is substantially identical in uniformity to the spectral light distribution of a desired daylight throughout the entire visible light spectrum from about 400 to about 700 nanometers, comprising:

(a) a filament which, when excited by electrical energy, emits radiant energy at least throughout the entire visible spectrum with wavelengths (1) from about 400 to about 700 nanometers, at non-uniform levels of radiant energy across the visible spectrum;

(b) a reflector body with a surface to intercept and reflect such visible spectrum radiant energy, and said filament is positioned within said reflector so that at least 50 percent of said visible spectrum radiant energy is directed towards said reflector surface; and (c) a filter coating on the surface of said reflector body, with a reflectance level to reflect radiance of every wavelength of the entire said visible spectrum radiant energy directed towards said reflector surface, and which when combined with the radiance of the visible spectrum radiant energy of the filament not directed towards said reflector surface produces a total usable visible light of relatively uniform radiance throughout every wavelength (l) of the visible spectrum in substantial accordance with the formula $$R(l)=[D(l)-[S(l)\times(1-X)]]/[S(l)\times X],$$

wherein R(l) is the reflectance of the reflector coating for each such wavelength l, D(l) is the radiance of said wavelength l for the desired daylight, S(l) is the total radiance of said filament at said wavelength, and X is the percentage of the visible spectrum radiant energy of the filament directed towards said reflector surface.

2. The lamp as recited in claim 1, wherein said total light output at each of said wavelengths is at least within about 30 percent of D(1) determined by said formula, but wherein the combined average of all of said wavelengths from about 400 to about 700 nanometers is within about 10 percent of the combined D(1) of all of said wavelengths.

3. The lamp according to claim 1, wherein the light directed towards said reflector is at least 90 percent of the light emitted by the filament.

4. The lamp according to claim 1, wherein the total visible light output of said filament is at least 80 candelas per watt and the total light output of said lamp is at least about 50 percent of the total visible light output of said filament.

5. The lamp according to claim 1, wherein said reflector is a parabolic reflector, and said filament is positioned substantially parallel to the axis of symmetry of said reflector.

6. The lamp according to claim 1 wherein said coating is comprised of at least five layers of dielectric material.

7. The lamp according to claim 6, wherein each of said layers of dielectric material has an index of refraction of from about 1.3 to about 2.6.

8. The lamp according to claim 7, wherein said coating has a nonuniform thickness across the surface of said reflector.

9. An incandescent lamp for producing a spectral distribution which is similar to that of daylight comprising a reflector with a concave inner surface and having a base and a rim at the open end thereof, an incandescent lamp bulb secured and mounted in the reflector through the base of the reflector, and a filament disposed within said lamp bulb to emit visible light throughout the entire visible light spectrum from about 400 to about 800 nanometers, wherein:

(a) said reflector reflects light throughout the visible light spectrum from about 400 nanometers to about 800 nanometers of the visible light spectrum, and when measured in ten-nanometer increments virtually throughout the visible light spectrum reflects more such light at each ten-nanometer increment as the ten-nanometer increments decrease from 800 nanometers to 400 nanometers;

(b) said reflector has a focal point which is located below the rim and the filament is disposed at a distance from said rim to direct at least about 50 percent of said visible light toward said reflector; and (c) said reflector is comprised of a substantially transparent substrate and at least about five layers of dielectric material coated onto one surface of said substrate, wherein:

1. each of said layers of said dielectric material is contiguous with each adjacent layer of dielectric material and has an index of refraction of from about 1.3 to about 2.6, and 2. each of said layers of said dielectric material has an index of refraction which differs from the index of refraction of each adjacent, contiguous layer of dielectric material.

10. The incandescent lamp according to claim 9, further comprising a cover slide secured and mounted on the top of said reflector.

11. The incandescent lamp according to claim 9, such filament is disposed within said lamp bulb such that:

(a) said lamp bulb produces an radiance of at least about 80 candelas per watt of power consumed by such lamp bulb;

(b) said reflector reflects an average of from about 80 to about 90 percent of all of the light with a wavelength between 400 and 500 nanometers, reflects an average of at least from about 50 to about 60 percent of all of the light with a wavelength between 500 and 600 nanometers, reflects an average of at least from about 40 to about 50 percent of all of the light with a wavelength between 600 and 700 nanometers, and reflects an average of at least from about 10 to about 20 percent of all of the light with a wavelength between about 700 and 800 nanometers.

12. The incandescent lamp according to claim 9, wherein the spectral reflectance curve produced by said reflector 12 is generally downwardly sloping between wavelengths of from about 400 to about 780 nanometers and is generally upwardly sloping between wavelengths of from about 380 to about 400 nanometers.

13. The incandescent lamp according to claim 9, wherein said reflector has a depth (as measured from its top surface to its vertex) which is less than about 200 millimeters.

14. The incandescent lamp according to claim 13, wherein said reflector has a focal point which is disposed at a distance from said top surface of at least about 50 percent of said depth of said reflector.

15. The incandescent lamp according to claim 9, wherein said filament is substantially centrally disposed about said focal point and is substantially aligned parallel with the axis of symmetry of said reflector.

16. The incandescent lamp as recited in claim 9, wherein said reflector is a parabolic reflector.

17. The incandescent lamp according to claim 9, and further comprising a light diffuser mounted on said rim of said reflector.

18. The incandescent lamp according to claim 17, wherein said diffuser has a globe shape.

19. The incandescent lamp according to claim 9, further comprising a light absorbing coating on the exterior surface of said reflector to convert radiant energy transmitted by the reflector to heat.

20. The incandescent lamp according to claim 19, further comprising heat dissipating fins disposed at the base of said reflector.

21. A light reflector for reflecting light from a filament which, when excited by electrical energy, emits radiant energy at least throughout the visible spectrum from about 400 to about 700 nanometers at non-uniform levels of radiant energy across the visible spectrum, the reflector producing from the emitted light impinging the reflector a spectral light distribution which when combined with the light not impinging the reflector is substantially identical in uniformity to the uniformity of the spectral light distribution of daylight throughout the entire visible light spectrum from about 400 to about 700 nanometers,the reflector comprising:

(a) a reflector body with a surface to intercept and reflect such visible spectrum radiant energy from said filament, and (b) a filter coating on the surface of said reflector body, with a reflectance level to reflect radiance of substantially all wavelengths of the entire said visible spectrum radiant energy directed towards said reflector surface, and which when combined with the radiance of the visible spectrum radiant energy not directed towards said reflector surface produces a total usable visible light of relatively uniform radiance throughout every wavelength (l) of the visible spectrum in substantial accordance with the formula $$R(l)=[D(l)-[S(l)\times(1-X)]]/[S(l)\times X],$$

wherein R(l) is the reflectance of the reflector coating for each such wavelength l, D(l) is the radiance of said wavelength l for the daylight color temperature, S(l) is the total radiance of said filament at said wavelength l, and X is the percentage of visible spectrum radiant energy directed towards said reflector surface.

* * * * *